US007753719B2

(12) United States Patent
Cheng

(10) Patent No.: US 7,753,719 B2
(45) Date of Patent: Jul. 13, 2010

(54) DC POWER PLUG WITH LED'S IMPROVED CONNECTING METHOD

(75) Inventor: Yung-Chang Cheng, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/381,772

(22) Filed: Mar. 17, 2009

(65) Prior Publication Data

US 2009/0233479 A1 Sep. 17, 2009

(30) Foreign Application Priority Data

Mar. 17, 2008 (CN) ..... 200820032163 U

(51) Int. Cl.
*H01R 3/00* (2006.01)

(52) U.S. Cl. ..... 439/490

(58) Field of Classification Search ..... 439/490, 439/752, 675, 607.4, 607.35
See application file for complete search history.

(56) References Cited

U.S. PATENT DOCUMENTS 6,319,062 B1 * 11/2001 Ma et al. ..... 439/607.38
6,409,530 B1 * 6/2002 Zhao et al. ..... 439/188
6,457,993 B1 * 10/2002 Espenshade ..... 439/490
6,478,610 B1 * 11/2002 Zhou et al. ..... 439/490
6,688,908 B2 * 2/2004 Wallace ..... 439/490
6,699,065 B1 * 3/2004 Espenshade et al. ..... 439/490
7,458,843 B2 * 12/2008 Xie ..... 439/490
7,648,385 B2 * 1/2010 Wu ..... 439/490

* cited by examiner

*Primary Examiner*—Phuong K Dinh
(74) *Attorney, Agent, or Firm*—Wei Te Chung; Andrew C. Cheng; Ming Chieh Chang

(57) ABSTRACT

An electrical connector includes a housing with a plurality of receiving spaces, a group of terminals received in the housing, an indicator received in the housing, and a shielding covering on the housing. The terminals include a central portion connected to anode and a contact portion connected to cathode. The indicator includes a pair of legs with ends exposed out of the housing. The shielding includes a first and second connecting portion extending from the back edge thereof. One of the two legs of indicator is connected to the first connecting portion. The contact portion is connected to the second connecting portion.

14 Claims, 5 Drawing Sheets

DC POWER PLUG WITH LED'S IMPROVED CONNECTING METHOD

BACKGROUND OF THE INVENTION

1. Field of the Invention

The present invention relates generally to a DC Power plug, and more particularly to a DC Power plug with a Light Emitting Diode (LED).

2. Description of the Prior Art

Direct current (DC) power jack has been widely used in electrical device to be connected to DC power plug to transmit direct current power. For showing whether the two connectors are connected to each other all right, an LED is assembled to the DC power jack. The LED has two terminals which are needed to be respectively connected to anode and cathode. The present DC power jack with an LED always connect the cathode terminal of LED to the cathode terminal of the DC power jack by a conductive wire. However, the process, that the wire is soldered on the cathode terminal of LED and DC power jack, is not suitable to roboticized production.

Hence, in this art, a DC power jack to overcome the above-mentioned disadvantages of the prior art should be provided.

BRIEF SUMMARY OF THE INVENTION

A primary object, therefore, of the present invention is to provide a DC power jack with LED and simple produce process.

In order to implement the above object, the electrical connector comprises a housing with a plurality of receiving spaces, a group of terminals received in the housing, an indicator received in the housing, and a shielding covering on the housing. The terminals comprise a central portion connected to anode and a contact portion connected to cathode. The indicator comprises a pair of legs with ends exposed out of the housing. The shielding comprises a first and second connecting portion extending from the back edge thereof. One of the two legs of the indicator is connected to the first connecting portion. The contact portion is connected to the second connecting portion.

Other objects, advantages and novel features of the invention will become more apparent from the following detailed description of a preferred embodiment when taken in conjunction with the accompanying drawings.

DETAILED DESCRIPTION OF THE INVENTION

Figure 1:
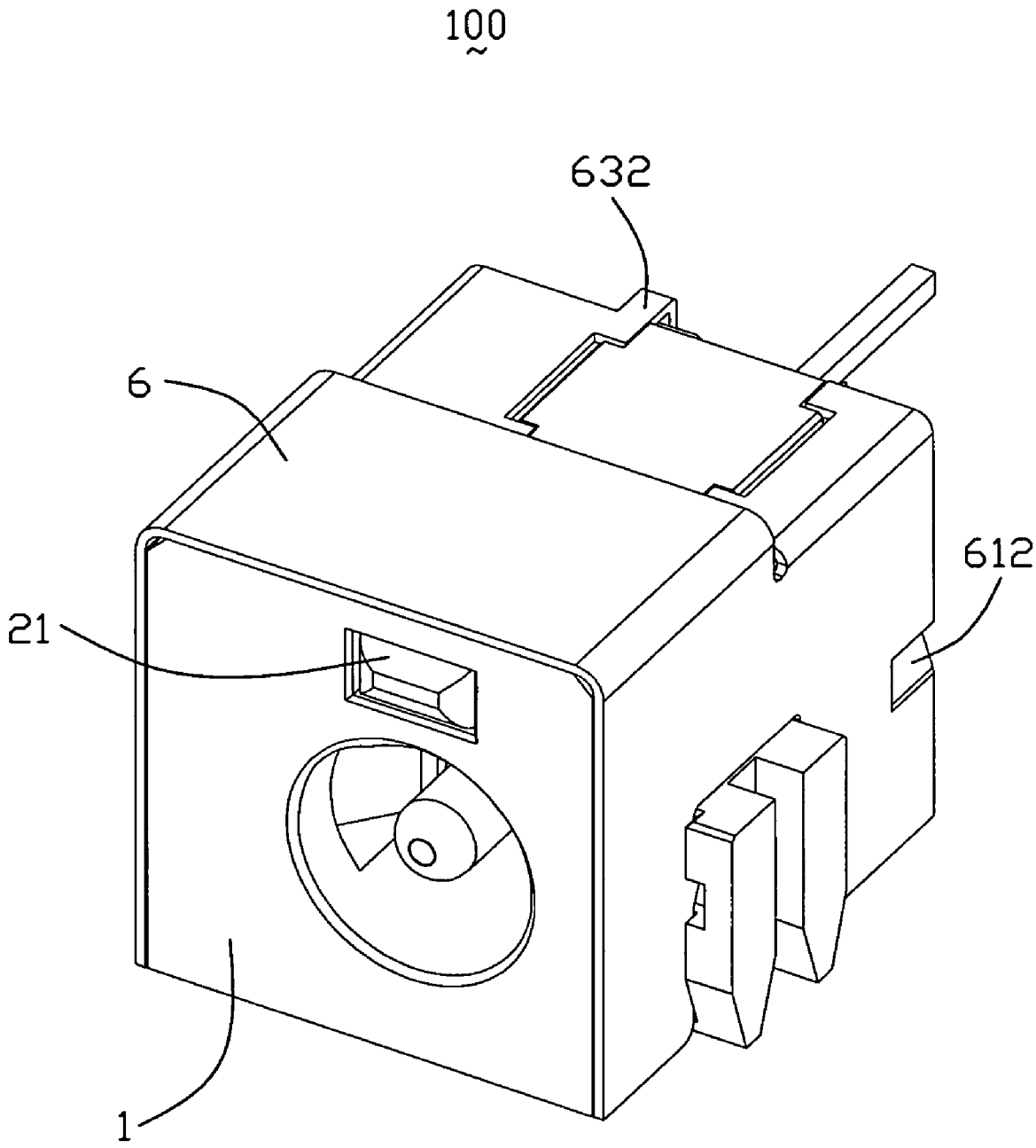
FIG. 1 is a perspective view illustrating a preferred embodiment of a DC power jack in according with the present invention.
Figure 2:
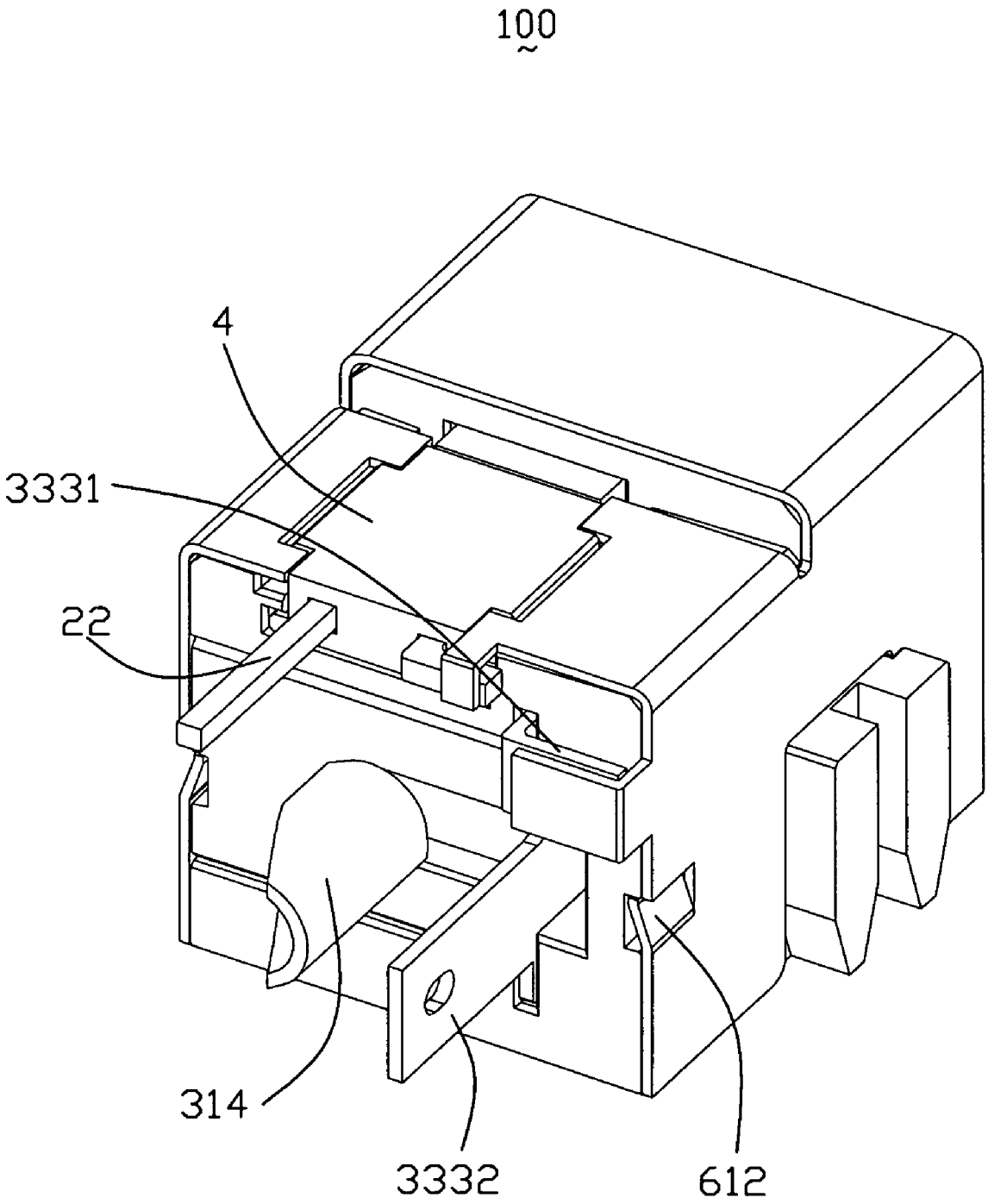
FIG. 2 is a perspective view of FIG. 1, but viewed from another angle.

Reference will now be made in detail to a preferred embodiment of the present invention.

Reference to FIGS. 1-4, a DC power jack made in according with a first embodiment of the present invention is shown. In the first embodiment, the DC power jack 100 comprises an insulative housing 1, an LED 2, a plurality of terminals 3, a first fastening block 4, a second fastening block 5 and a shielding 6 attached to the insulative housing 1.

The housing 1 comprises a frontal surface 11, a back surface 12, two side surfaces 13, a higher first top surface 14 and a lower second top surface 15 abut on the first top surface 14. A first receiving space 16 backwardly extends from the center of the frontal surface 11 of the housing 1. A receiving cavity 17 backwardly extends from the frontal surface 11 and is located above the first receiving space 16. A receiving groove 150 extends across the second top surface 15 to be connected to the receiving cavity 17. The receiving groove 150 is approximately of T shape and comprises a main groove 1502, a pair of guiding groove 1503 on the two sides of the main groove 1502. A pair of restricting grooves 1501, which is shorter than the receiving groove 150, respectively extends from the bottom of the two side walls of the main groove 1502 and is connected to the main groove 1502. A second receiving space 18 extends forwardly from the back surface 12 to be connected to the first receiving space 16. The second receiving space 18 comprises a pair of guiding trough 181 respectively extending from one side surface 13 of the housing 1 and located on the upper and lower edges thereof, and a supporting stage 182 on the center thereof. A first receiving passage 1821 and a second receiving passage 1822 are respectively defined on the two sides of the supporting stage 182 and extending along a front-to-back direction to be connected to the first and second receiving space 16, 18. A third receiving passage 123 forwardly extends from the back surface 12 to be connected with the first and second receiving spaces 16, 18. Two pair of holding block 131 respectively extends from the two side surfaces 13 of the housing 1. Each pair of the holding block 131 comprises a frontal holding block and a rear holding block. Each one of the frontal holding block 131 comprises a fixing portion 132 on the middle of the joint of the frontal holding block 131 and the corresponding side surface 13. A grasping groove 133 is defined between the two holding blocks 131. A restricting cutout 134 is defined on the middle of the joint of one side surface 13 and the back surface 12.

The LED 2 comprises an indicator light 21 received in the receiving cavity 17 and a pair of conductive legs 22. The two conductive legs 22 is separated to a first L-shape conductive leg 221 and a linear conductive leg 222. In other embodiment, the shape of the two legs can be changed to adapt for different requires.

The terminals 3 comprise a central portion 31 for transmitting anode power, a flexible portion 32 and a contact portion 33 transmitting cathode power. The central portion 31, which is received in the first receiving passage 1821 and be of columnar shape, comprises a matching portion 311 connected to a complementary connector, a connecting portion 314 connected to wires, and a fastening portion 312 between the matching portion 311 and the connecting portion 314 to connect the matching portion 311 and the connecting portion 314. A channel 313 is formed between the fastening portion 312 and the connecting portion 314. The fastening portion 312 is of approximately columnar shape, and has a plane and an arc surface connected to the plane to form a circumferential surface thereof. The fastening portion 312 is received in the first receiving passage 1821 and the matching portion 311 is received in the center of the receiving space 16. The flexible portion 32, which is inserted into the housing 1 with passing through the back surface 12, the second receiving passage 1822 and the first receiving space 16, comprises a first flexible touching portion 321 received in the first receiving space 16 and a second fastening portion 322 received in the second receiving passage 1822. The first touching portion 321 is used to enhance the grasping strength between the complementary connector and the DC power jack 100. The contact portion 33, which is inserted into the third receiving passage 123 with passing through the back surface 12, the third receiving passage 123 and the first receiving space 16, comprises a second touching portion 331 received in the first receiving space 16, a second fastening portion 332 received in the third receiving passage 123, and an attaching portion 333 connected to the second fastening portion 332. The second touching portion 331 is connected to the terminal of the complementary connector to enhance the fastening strength between the DC power jack and the complementary connector. The attaching portion 333, which is exposed out of the housing 1, comprises a first arm 3331 parallel to the back surface 12 and a second arm 3332 perpendicular to the back surface 12. The second arm 3332 is soldered to wires.

Figure 3:
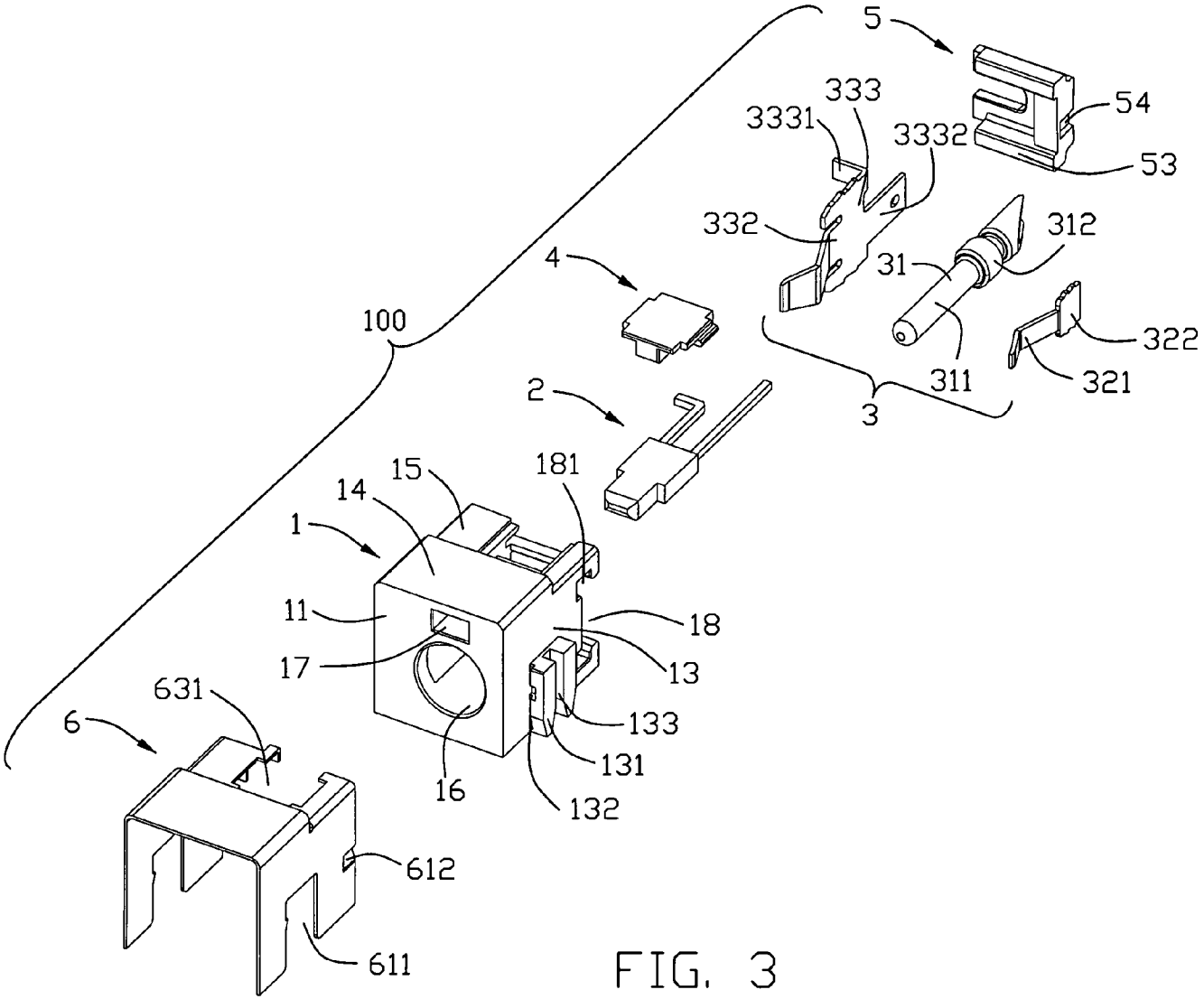
FIG. 3 is a exploded perspective view of FIG. 1.
Figure 4:
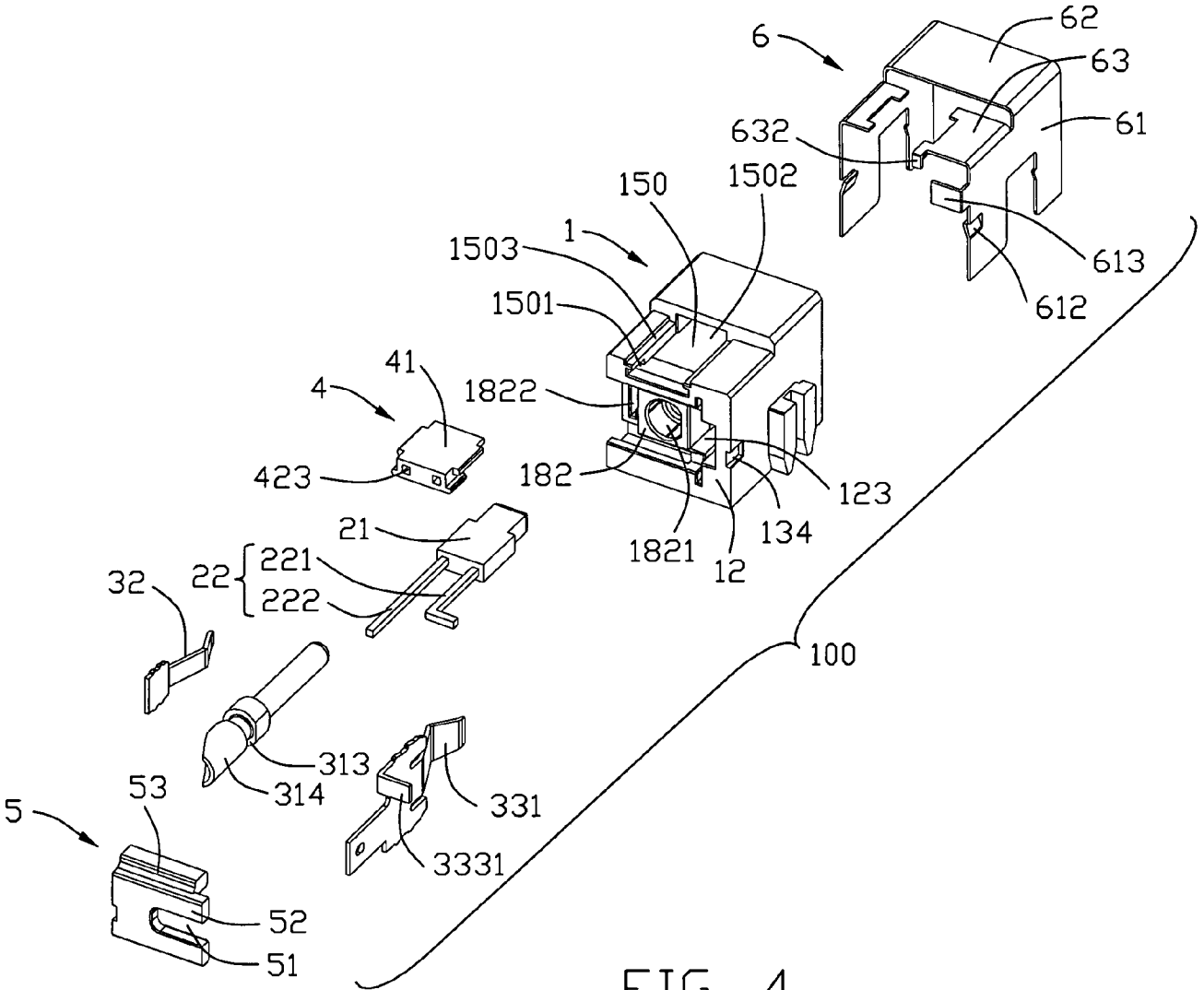
FIG. 4 is a exploded perspective view of FIG. 2.
Figure 5:
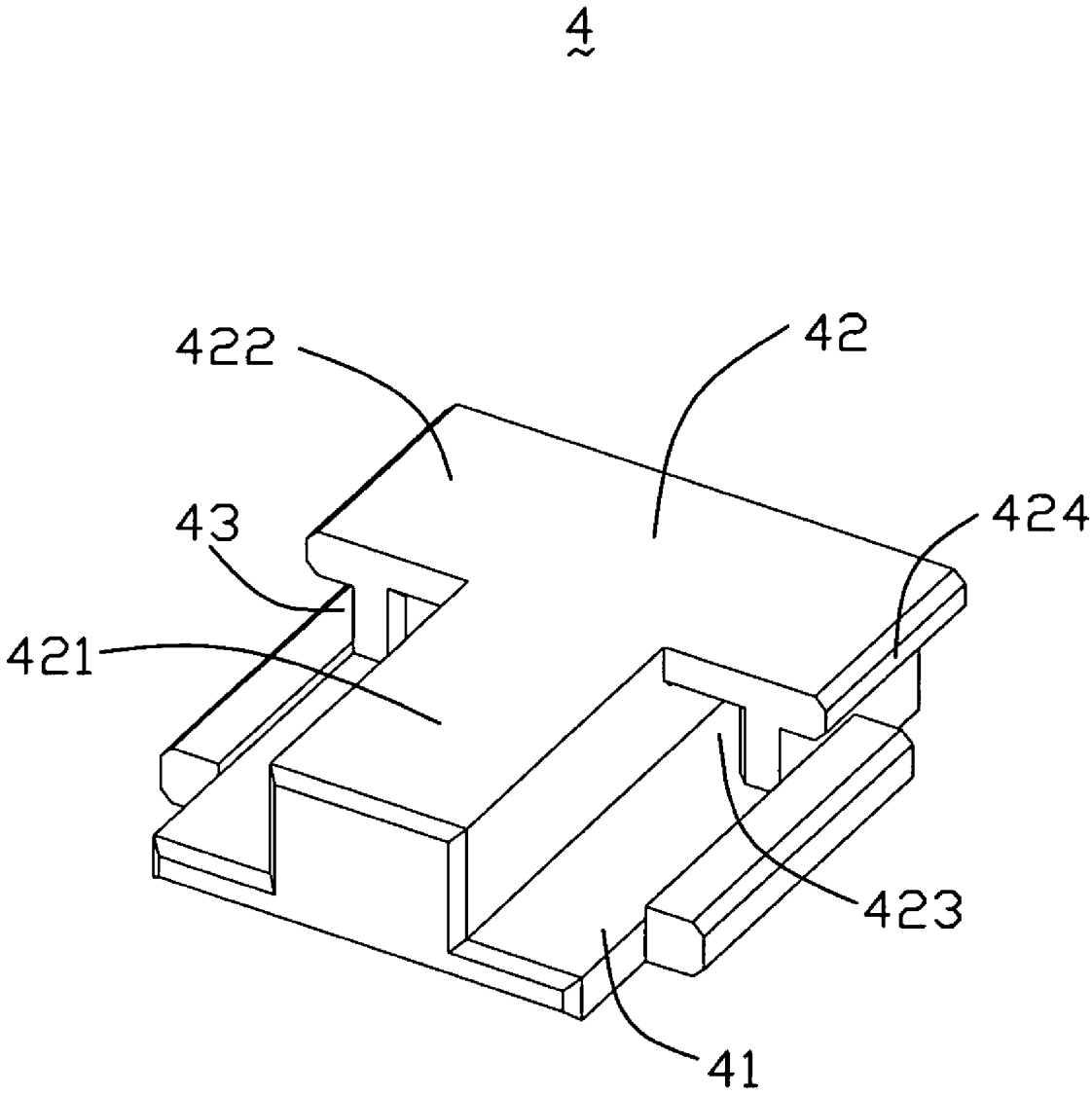
FIG. 5 is a part of a housing of the DC power jack.

Reference to FIGS. 3 to 5, the first fastening block 4 is received in the groove 150 of the housing 1, comprises a cross-shaped first portion 41 and a T-shaped second portion 42. The second portion 42 comprises a main portion 421 and a pair of winglike portion 422 respectively extending from the two sides of the main portion 421. Each one of the two winglike portions 422 comprises a passage 423 connected to the main portion 421. A pair of restricting rim portions 424 outward extends from the two out sides of the winglike portions 422 and has top surfaces lying in the same plane with the top surfaces of the winglike portions 422. The two conductive legs 22 LED 2 respectively pass through the two sides of the main portion 421 and the two passages 423 in turn to make each one of the two conductive legs 22 have an end exposed out of the fastening block 4 and the indicator light 21 be in front of the first fastening block 4. The first portion 41 comprises a pair of side limbs 43. The indicator light 21 with the fastening block 4 is inserted into the housing 1 along guiding groove 150 and received in the receiving cavity 17. The side limbs 43 are received in the two guiding grooves 1503, the two restricting rim portions 424 are respectively received in the two restricting grooves 1501.

The second fastening block 5 is of U-shaped configuration and received in the second receiving space 18 of the housing. The second fastening block 5 comprises a U-shape bar 52 with two legs running in the channel 313 of the center terminal 31, an open 51 formed between the bar 52 and opening toward the contact portion 33, a pair of ribs 53 respectively extending upward and downward from the upper and down edges of the bar 52, and a fixing groove 54 formed on one side of the bar 52 opposite to the open 51.

The shielding 6 comprises a top wall and two side walls 61. The top wall comprises a first top wall 62 covered the first top surface 14 of the housing 1 and a second top wall 63 with two pieces respectively extending inward from the top of the two side walls 61. The two pieces are separated from each other to form an opening 631 to receive the first retaining block 4. A first L-shape connecting portion 632 extends backward from the back edge of one of the two pieces of the second top wall 63 to make the end of the first L-shape conductive leg 221 of the LED 2 be received between the first connecting portion 632 and the second top wall 63 and connected to the first connecting portion 632. A second L-shape connecting portion 613 extends backward from one of the two side walls 61 to make the first arm 3331 of the contact portion 33 be received between the second connecting portion 613 and the side wall 61 and connected to the second connecting portion 613. Two openings 611 are respectively formed on the two side walls 61 to correspond to the two holding blocks 131. A restricting slice 612 is formed on middle of the back edge of one side wall 61 to correspond to the restricting cutout 134.

Reference to FIGS. 1 to 4, in assembly, firstly the central portion 31, the flexible portion 32 and the contact portion 33 are respectively inserted into the first receiving passage 1821, the second receiving passage 1822 and the third receiving passage 123. And the front end of the terminals are received in the first receiving space 16. Secondly, the LED 2 with the first fastening block 4 is inserted into the receiving cavity 17 and the first fastening block 4 is received in the receiving groove 150 with the two side limbs 43 being received in the guiding groove 1503 and the two restricting rim portions 424 being received in the restricting grooves 1501. Thirdly, the second fastening block 5 is inserted into the second receiving space 18 accompanying with the bar 52 passing through the channel 313 of the central portion 31 and the ribs 53 being received in the guiding trough 181. Lastly, the shielding 6 is assembled on the housing to cover the first top surface 14, a part of the second top surface 15 and two side surfaces 13 to make the first connecting portion 632 connected to the first L-shape conductive leg 221 and the second connecting portion 613 connected to the first arm 3331 of the contact portion 333.

The DC power jack 100 further comprises a plurality of wires soldered to the terminals. Through the wires the center terminal 31 is connected to anode, the second leg 222 of the LED 2 is connected to anode, and the contact portion 33 is connected to cathode. The first leg 221 is electrical connected to the contact portion 33 through shielding 6, and thus, the first leg 221 is connected to cathode. In other embodiment, the LED 2 can be changed to be other indicator which has capability of indicating the working state of the DC power jack 100.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

a housing comprising a plurality of receiving spaces;

a group of terminals received in the housing and comprising a central portion connected to anode and a contact portion connected to cathode;

an indicator received in the housing and comprising a pair of legs with ends exposed out of the housing;

a shielding covering on the housing and comprising a first and second connecting portions extending from a back edge thereof;

one of said two legs of the indicator being connected to the first connecting portion and said contact portion being connected to the second connection portion, wherein said two legs of the indicator are respectively a linear shape and an L shape, wherein said L-shaped leg of the indicator is connected to the first connecting portion and between the first connecting portion and the housing.

2. The electrical connector as claimed in claim 1, wherein said first connecting portion is L-shaped.

3. The electrical connector as claimed in claim 1, wherein said contact portion comprises a first arm between the second connecting portion and the housing and connected to the second connecting portion, and a second arm exposed out of the housing.

4. The electrical connector as claimed in claim 1, wherein said housing comprises a first receiving space backwardly extending from the center of the frontal surface thereof, a receiving cavity backwardly extending from the frontal surface thereof above the first receiving space, and a receiving groove extending across the second top surface to be connected to the receiving cavity.

5. The electrical connector as claimed in claim 4, wherein said receiving groove is approximately of T shape and comprises a main groove, a pair of guiding groove on the two sides of the main groove, a pair of restricting grooves shorter than the receiving groove and respectively extending from the bottom of the two side walls of the main groove to be connected to the main groove, and a second receiving space extending forwardly from the back surface to be connected to the first receiving space.

6. The electrical connector as claimed in claim 5, wherein said second receiving space comprises a pair of guiding troughs respectively extending from one side surface of the housing and located on the upper and lower edges thereof, and a supporting stage on the center thereof.

7. The electrical connector as claimed in claim 6, wherein said housing further comprise a first receiving passage and a second receiving passage respectively defined on the two sides of the supporting stage and extending along a front-to-back direction to be connected to the first and second receiving spaces, and a third receiving passage forwardly extending from the back surface to be connected with the first and second receiving spaces.

8. The electrical connector as claimed in claim 7, wherein said housing comprises two pair of holding blocks respectively extending from the two side surfaces of the housing to form two grasping grooves therebetween, each pair of the holding blocks comprising a frontal holding block with a fixing portion on the middle thereof and a rear holding block.

9. The electrical connector as claimed in claim 8, wherein said central portion is received in the first receiving passage and is of columnar shape.

10. The electrical connector as claimed in claim 8, wherein said terminal further comprises a flexible portion inserted into the housing and passing through the back surface, the second receiving passage and the first receiving space.

11. The electrical connector as claimed in claim 1, further comprising a plurality of wires respectively connected to the terminals.

12. The electrical connector as claimed in claim 1, further comprising two fastening blocks respectively fastening the indicator and the terminals.

13. An electrical connector, comprising:

an insulative housing defining a mating cavity along a front-to-back direction;

a group of terminals received in the housing and comprising a central portion connected to anode and a contact portion connected to cathode;

a fastening block assembled to the housing in a transverse direction perpendicular to said front-to-back direction, and locking a neck section of the central portion for holding the central portion in position in the housing; and a shielding covering on the housing, said shielding being configured to be assembled to the housing in a vertical direction perpendicular to said front-to-back direction and said transverse direction; wherein, said shielding includes a tab butting within a recess in the fastening block so as to prevent both said shielding and said fastening block from being withdrawn from each other.

14. An electrical connector comprising:

a housing comprising a plurality of receiving spaces;

a group of terminals received in the housing and comprising a central portion connected to anode and a contact portion connected to cathode;

an indicator received in the housing and comprising a pair of legs with ends exposed out of the housing;

a shielding covering on the housing; and one of said two legs of the indicator and said contact portion being connected to shielding; wherein, The central portion and the other leg extend in a straight manner while said one leg and the contact portion are bent and abutting against by the shielding, wherein said two legs of the indicator are respectively a linear shape and an L shape, wherein said L-shaped leg of the indicator is connected to the first connecting portion and between the first connecting portion and the housing, wherein said contact portion and said one leg are bent under the shielding.

* * * * *